US006893274B2

(12) United States Patent
Chen et al.

(10) Patent No.: US 6,893,274 B2
(45) Date of Patent: May 17, 2005

(54) STRUCTURE OF GROUND PIN FOR AC INLET AND PROCESS FOR FASTENING WIRE ONTO SAME

(75) Inventors: Chen Chun Chen, Taoyuan (TW); Chih Chiang Lin, Taoyuan (TW)

(73) Assignee: Delta Electronics, Inc., Taoyuan Shien (TW)

( * ) Notice: Subject to any disclaimer, the term of this patent is extended or adjusted under 35 U.S.C. 154(b) by 31 days.

(21) Appl. No.: 10/075,059

(22) Filed: Feb. 11, 2002

(65) Prior Publication Data

US 2003/0040204 A1 Feb. 27, 2003

(30) Foreign Application Priority Data

Aug. 27, 2001 (TW) ..... 90214660 U

(51) Int. Cl.[7] ..... H01R 4/66
(52) U.S. Cl. ..... 439/106
(58) Field of Search ..... 439/106, 877–882, 439/874, 875, 876, 96, 95; 174/94 R, 94 S, 84 C; 24/129 B; 248/301; 228/170

(56) References Cited

U.S. PATENT DOCUMENTS 2,224,547 A * 12/1940 Ludwig ..... 439/598
2,947,968 A * 8/1960 Mapelsden et al. ..... 439/881
3,520,004 A * 7/1970 Patnaude ..... 4/503
3,916,139 A * 10/1975 Schantz ..... 219/85
4,500,149 A * 2/1985 Mackay ..... 439/83
4,571,019 A * 2/1986 Arai ..... 439/881
4,737,115 A * 4/1988 Seidler ..... 439/83
6,565,376 B2 * 5/2003 Aoki ..... 439/422

* cited by examiner

*Primary Examiner*—Ross Gushi
(74) *Attorney, Agent, or Firm*—Gazdzinski & Associates

(57) ABSTRACT

A structure of the AC inlet is provided. The structure includes a main body, at least one power terminal, at least one power pin coupled with the at least one power terminal and electrically connected to a circuit board, a ground terminal for accepting a ground signal from the AC power source, and a ground pin grounded through a wire and having a first strip coupled with the ground terminal and a second strip essentially parallel with a surface of the main body. The structure is characterized in that the free end of the second strip has a notch for accommodating a bare wire end of the wire and a projecting plate inclined at an elevation angle with the second strip, and the projecting plate is pressed downwards for fastening the bare ware end.

6 Claims, 7 Drawing Sheets

STRUCTURE OF GROUND PIN FOR AC INLET AND PROCESS FOR FASTENING WIRE ONTO SAME

FIELD OF THE INVENTION

The present invention relates to a structure of a ground pin, and more particularly to a structure of a ground pin for an AC inlet.

BACKGROUND OF THE INVENTION

The power supply apparatus such as an adapter is widely used for rectifying and converting AC power into DC power. FIGS. 1(*a*) and 1(*b*) are respectively exploded and perspective views of a conventional power supply apparatus. Such power supply apparatus includes an upper housing 1 and a lower housing 2. A space is defined between the upper housing 1 and the lower housing 2 for accommodating a circuit board 3 therein. An AC inlet 4 and other electronic components 30 required for the power supply apparatus are mounted on the circuit board 3. A first concave 11 and a second concave (not shown) are respectively provided on the front side and the rear side of the upper housing 1. A third concave 21 and a fourth concave 22, opposite to the first concave 11 and the second concave, are respectively provided on the front side and the rear side of the lower housing 2. When the upper housing 1 and the lower housing 2 are jointed together, the first concave 11 and the third concave 21 forms a slot for infixing the AC inlet 4 therein to receive external AC power. The circuitry mounted on the circuit board 3 converts the AC power supply into a DC power supply, and the converted DC power is supplied to electrical appliances such as printers, radios and modems.

Referring to FIGS. 2(*a*) and 2(*b*), the AC inlet 4 basically includes an insulating main body 40, two power terminals 411, 412 and a ground terminal 413. The power terminals 411, 412 and the ground terminal 413 are located in a cave 41 inside the main body 40 and pass through the apertures (not shown) on the backside surface 401 of the main body 40. The power terminals 411, 412 are respectively coupled with the power pins 431, 432 via rivets 421, 422. The power pins 431, 432 are further inserted into the corresponding pinhole 31, 32 on the circuit board 3 (FIG. 1(*a*)), and subsequently fixed to the circuit board 3 by welding technique. The power terminals 411 and 412 are utilized to accept electrical signals of AC power through the power pins 431, 432 into the circuit board 3. The ground terminal 413, which is used for accepting a ground signal, is coupled with a ground pin 433 via a rivet 423. The ground pin 433 is essentially L-shaped and includes a first strip 4331 and a second strip 4332, wherein the first strip 4331 and the second strip 4332 are parallel with the backside surface 401 and the topside surface 402 of the main body 40, respectively. In addition, the second strip 4332 has a hole 4331.

Please refer to FIGS. 3(*a*) and 3(*b*). The ground pin 433 is grounded by being electrically connected to a ground voltage on the circuit board 3 via a wire 45. The process for fastening the wire 45 onto the ground pin 433 is performed by inserting a bare wire end 451 of the wire 45 into the hole 4331 (FIG. 3(*a*)) and then applying solder 452 around the hole 4331 to weld the bare wire end 451 (FIG. 3(*b*)).

It is found that a portion of the solder 452 might be stripped by carelessly pulling the wire 45 or due to the heat transferred from the electronic components 30 in operation. Moreover, the wire 45 will be disconnected with the ground pin 433 such that the grounding effect is largely reduced.

SUMMARY OF THE INVENTION

Therefore, the present invention provides an improved structure of a ground pin for an AC inlet so as to overcome the problems described above.

It is an object of the present invention to provide a structure of an AC inlet with an improved ground pin to preliminarily fix a bare wire end so as to increase welding effect and facilitate grounding effect.

In accordance with one aspect of the present invention, there is provided a structure of an AC inlet. The structure of the AC inlet includes a main body, at least one power terminal for accepting an electrical signal from an AC power source, at least one power pin coupled with the at least one power terminal and electrically connected to a circuit board, a ground terminal for accepting a ground signal from the AC power source, and a ground pin grounded through a wire and having a first strip coupled with the ground terminal and a second strip essentially parallel with a surface of the main body. The structure of the AC inlet is characterized in that the free end of the second strip has a notch for accommodating a bare wire end of the wire and a projecting plate inclined at an elevation angle with the second strip, and the projecting plate is pressed downwards for fastening the bare ware end.

Preferably, the elevation angle is from 20 to 50 degrees. More preferably, the elevation angle is from 30 to 45 degrees.

Preferably, the width of the projecting plate is slightly less than that of the notch, and the length of the projecting plate is the same as that of the notch.

In accordance with one aspect of the present invention, there is provided a process for fastening a wire onto a ground pin of an AC inlet, wherein the ground pin has a strip essentially parallel with a surface of the AC inlet, and the free end of the strip has a notch and a projecting plate inclined at an elevation angle with the strip. The process includes steps of placing a bare wire end of the wire in the notch wherein a portion of the bare wire end is in contact with the surface, turning downwards the projecting plate to compress the bare wire end, and welding the bare wire end.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
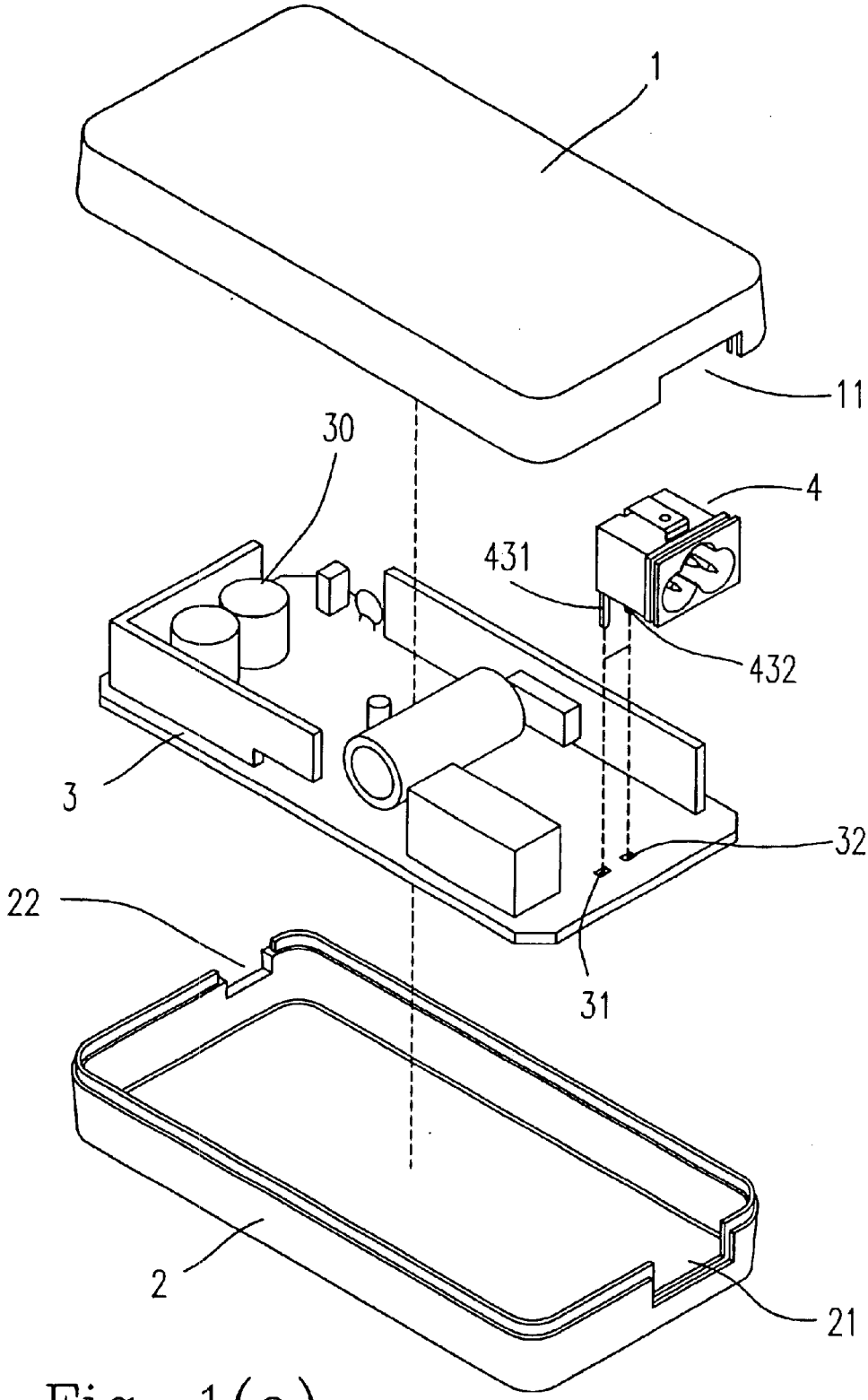
Fig. 1(a) PRIOR ART
FIGS. 1(*a*) and 1(*b*) are respectively exploded and perspective views of a conventional power supply apparatus.
Figure 1B:
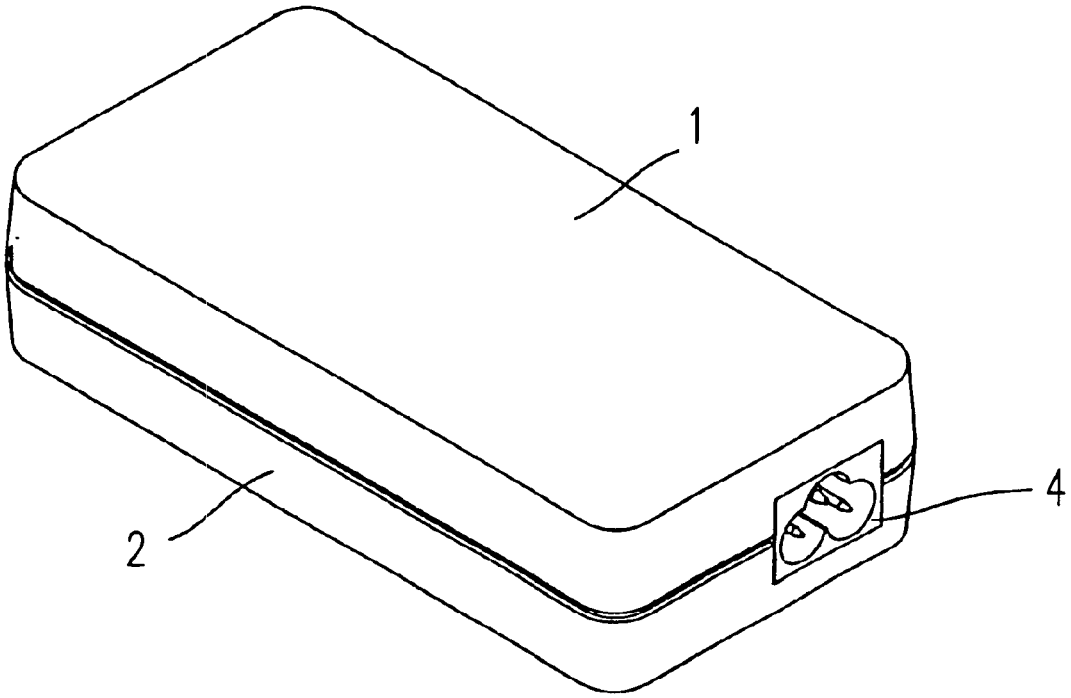
Fig. 1(b) PRIOR ART
Figure 2A:
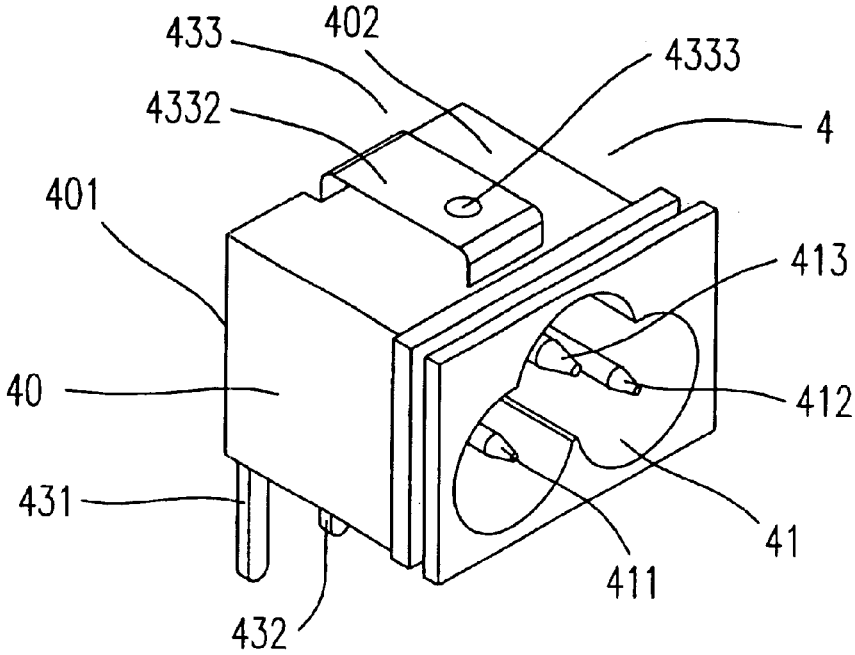
Fig. 2(a) PRIOR ART
FIGS. 2(*a*) and 2(*b*) are respectively perspective and rear views of an AC inlet according to prior art.
Figure 2B:
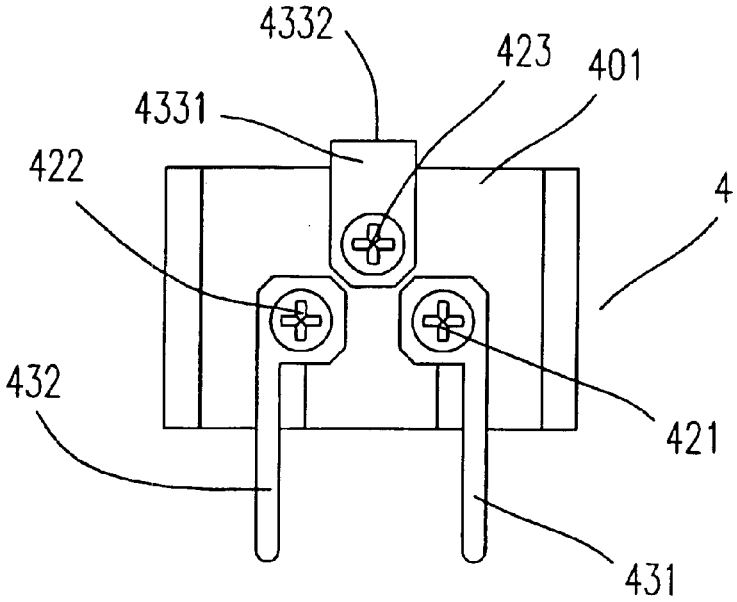
Fig. 2(b) PRIOR ART
Figure 3A:
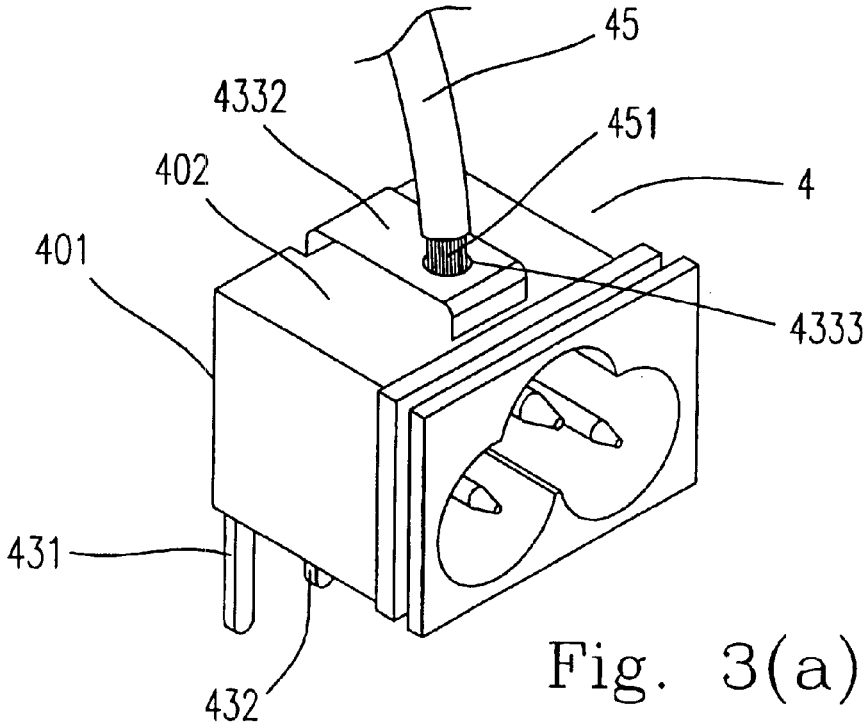
Fig. 3(a) PRIOR ART
FIGS. 3(*a*) and 3(*b*) are views illustrating the steps for fastening a wire onto a ground pin of an AC inlet according to prior art.
Figure 3B:
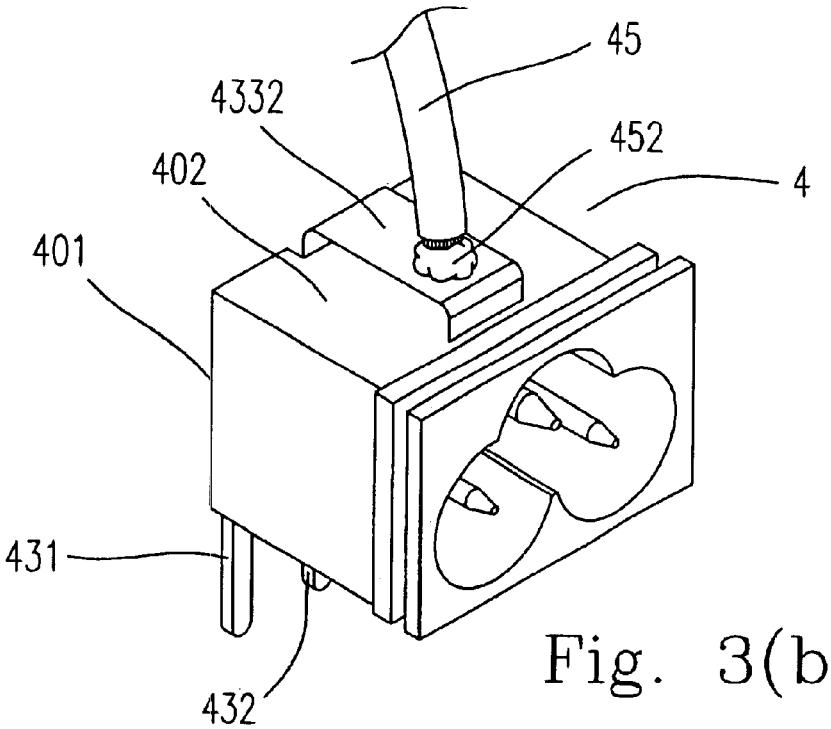
Fig. 3(b) PRIOR ART
Figure 4A:
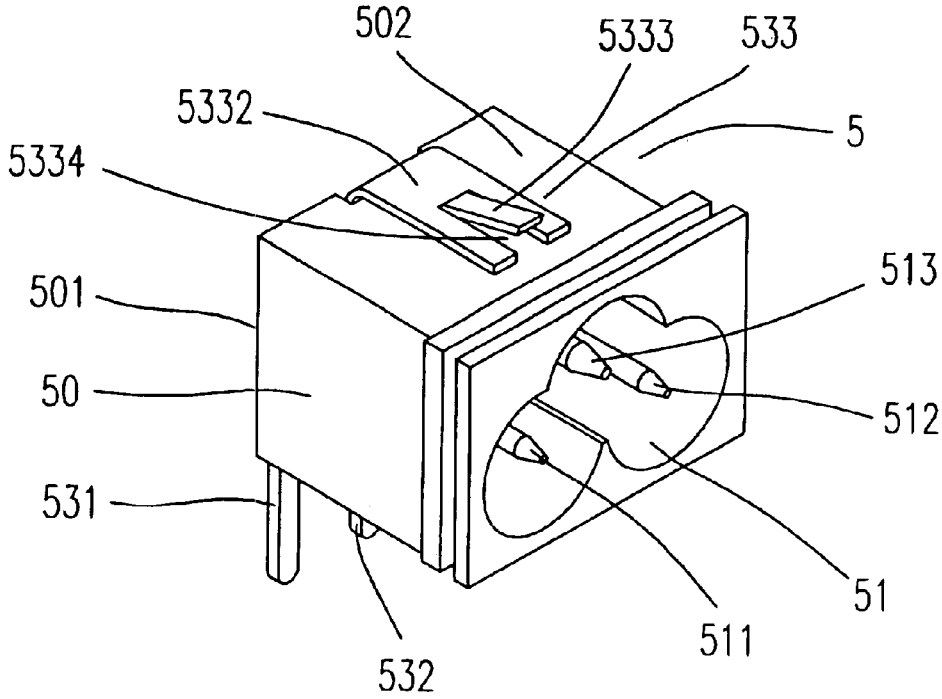
FIGS. 4(*a*) and 4(*b*) are respectively perspective and rear views of an AC inlet according to a preferred embodiment of the present invention.
Figure 4B:
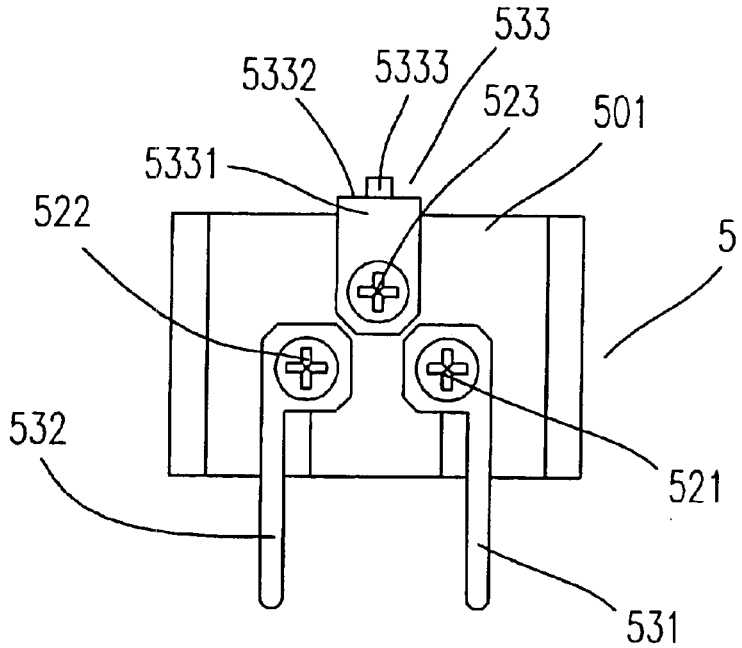

Please refer to FIGS. 4(*a*) and 4(*b*). The AC inlet 5 of the present invention includes two power terminals 511 and 512 and a ground terminal 513, which are located in a cave 51 inside the main body 50 and pass through an apertures (not shown) on the backside surface 501 of the main body 50. The two power terminals 511, 512 are respectively coupled with two power pins 531, 532 via rivets 521, 522 and will be inserted into the corresponding pinholes 31, 32 on the circuit board 3 (as in FIG. 1(*a*)) and subsequently fixed to the circuit board 3 by welding technique. In such way, the power terminals 511, 512 could accept an electrical signal from an AC power source and electrically connected to the circuit board 3. The ground terminal 513 is employed to accept a ground signal from the AC power source and coupled with a ground pin 533 via a rivet 523. The ground pin 533 is essentially L-shaped and composed of a first strip 5331 and a second strip 5332, wherein the first strip 5331 and the second strip 5332 are parallel with the backside surface 501 and topside surface 502 of the main body 50, respectively. The first strip 5331 is coupled with the ground terminal. The free end of the second strip 5332 has a notch 5334 and a projecting plate 5333. The projecting plate 5333 is inclined at an elevation angle with the second strip 5332. The elevation angle is preferably from 20 to 50 degrees, and more particularly from 30 to 45 degrees. In this embodiment, the width of the projecting plate 5333 is slightly less than that of the notch 5334, and the length of the projecting plate 5333 is essentially the same as that of the notch 5334.

Figure 5A:
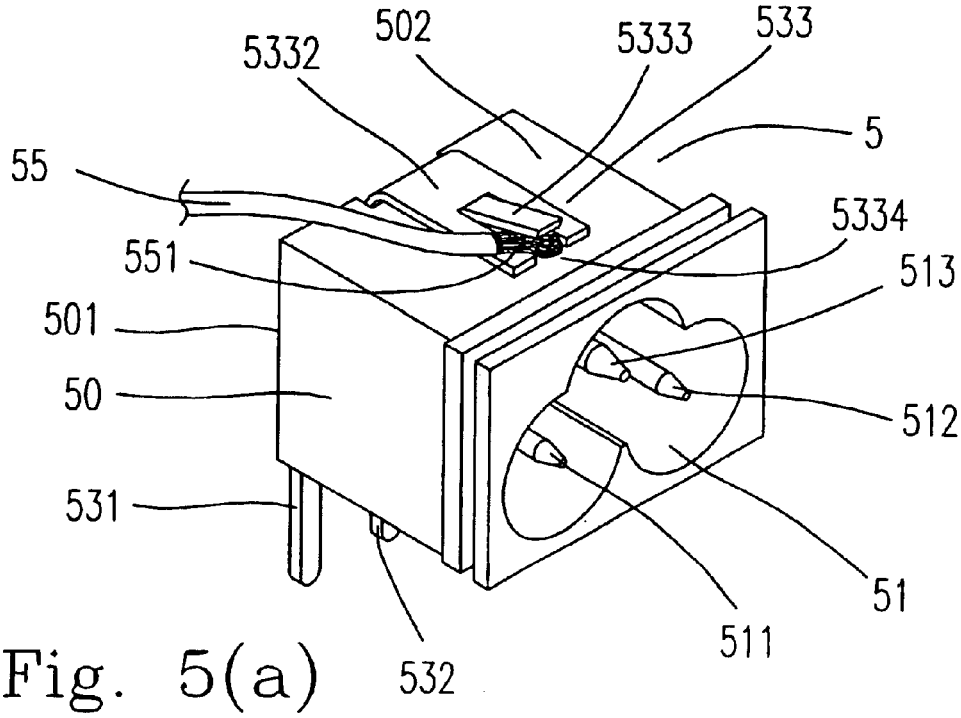
FIGS. 5(*a*) to 5(*c*) are diagrams illustrating the steps for fastening a wire onto a ground pin of an AC inlet according to a preferred embodiment of the present invention.
Figure 5B:
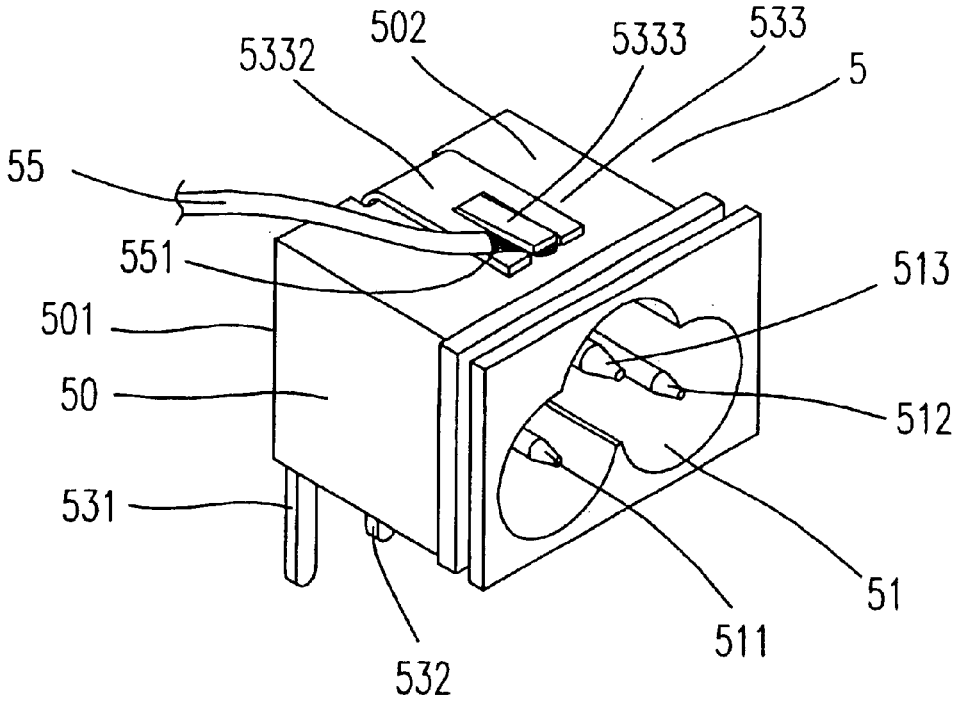
Figure 5C:
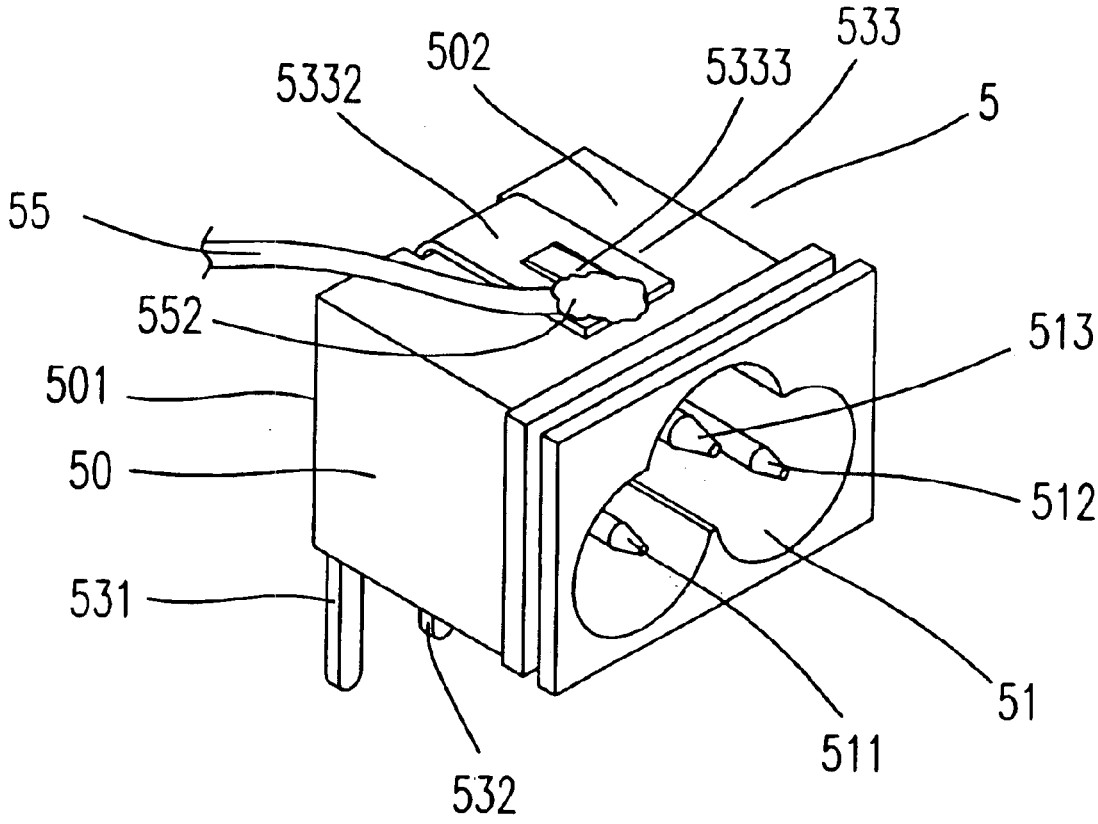

FIGS. 5(*a*) to 5(*c*) are diagrams illustrating the steps for fastening a wire 55 onto the ground pin 533 of the AC inlet 5. In FIG. 5(*a*), a bare wire end 551 of the wire 55 is placed in the notch 5334 and a portion of the bare wire end 551 is in contact with the topside surface 502. Then, the projecting plate 5333 is turned downwards to compress the bare wire end 551, as can be seen in FIG. 5(*b*). In such way, the bare wire end 551 can be preliminarily fixed. Referring to FIG. 5(*c*), the bare wire end 551 is finally welded by applying solder 552.

It is believed that the welding effect could also be enhanced according to the present invention because the effective solder is largely increased. Therefore, the wire 55 is firmly fastened onto the ground pin 533.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A structure of an AC inlet, comprising a main body, at least one power terminal for accepting an electrical signal from an AC power source, at least one power pin coupled with said at least one power terminal and electrically connected to a circuit board, a ground terminal for accepting a ground signal from said AC power source, and a ground pin grounded through a wire and having a first strip coupled with said ground terminal and a second strip essentially parallel with a surface of said main body, characterized in that:

the free end of said second strip has a notch for accommodating a bare wire end of said wire and a projecting plate inclined at an elevation angle with said second strip, said projecting plate is pressed downwards for fastening said bare wire end, and the width of said projecting plate is slightly less than that of said notch by a preselected value.

2. The structure according to claim 1 wherein said elevation angle is from 20 to 50 degrees.

3. The structure according to claim 2 wherein said elevation angle is from 30 to 45 degrees.

4. The structure of claim 1, wherein said preselected value is selected to increase the resistance to separating said bare wire end of said wire from said structure.

5. AC connection apparatus, comprising:

a main body;

at least one power terminal for accepting an electrical signal from an AC power source;

at least one conductor coupled with said at least one power terminal and electrically connected to a circuit board;

a ground terminal for accepting a ground signal from said AC power source; and a ground conductor grounded through a wire and having a first conductive element coupled with said ground terminal and a second conductive element disposed proximate to said main body;

wherein the free end of said second conductive element has an aperture for accommodating a bare end of said wire and a projecting plate inclined at an elevation angle with said second conductive element, said projecting plate adapted for fastening said bare end, said projecting plate having a width less than that of said aperture by a purposely selected amount.

6. The apparatus of claim 5, wherein said bare end of said wire is welded or soldered to said apparatus, and said purposely selected amount is selected to increase the effect of said welding or soldering.

* * * * *